US009423132B2

(12) United States Patent
Axelsson et al.

(10) Patent No.: US 9,423,132 B2
(45) Date of Patent: Aug. 23, 2016

(54) ULTRA LOW EMISSIONS GAS TURBINE COMBUSTOR

(75) Inventors: Axel Lars-Uno Eugen Axelsson, Hengelo (NL); Martin Beran, Prague (CZ); Ekaterina Sinkevich, Enschede (NL)

(73) Assignee: OPRA TECHNOLOGIES B.V. (NL)

( * ) Notice: Subject to any disclaimer, the term of this patent is extended or adjusted under 35 U.S.C. 154(b) by 1099 days.

(21) Appl. No.: 12/926,322

(22) Filed: Nov. 9, 2010

(65) Prior Publication Data

US 2012/0111012 A1 May 10, 2012

(51) Int. Cl.

| | |
|---|---|
| ***F23R 3/14*** | (2006.01) |
| ***F23R 3/16*** | (2006.01) |
| ***F23R 3/54*** | (2006.01) |
| ***F23R 3/28*** | (2006.01) |

(52) U.S. Cl.

CPC . *F23R 3/14* (2013.01); *F23R 3/16* (2013.01); *F23R 3/286* (2013.01); *F23R 3/54* (2013.01); *F23D 2900/14021* (2013.01); *F23R 2900/03044* (2013.01)

(58) Field of Classification Search

CPC ..... F23R 3/14; F23R 3/16; F23R 3/54; F23R 3/286; F23R 2900/03044; F23D 2900/14021

USPC ..... 60/748, 751–760, 39.37; 431/10, 12

See application file for complete search history.

(56) References Cited

U.S. PATENT DOCUMENTS 3,831,854 A 8/1974 Sato et al.
3,975,141 A * 8/1976 Sweet ..... 431/352
4,339,925 A * 7/1982 Eggmann et al. ..... 60/757
4,796,429 A * 1/1989 Verdouw ..... 60/751
4,872,312 A * 10/1989 Iizuka et al. ..... 60/760
4,971,768 A * 11/1990 Ealba et al. ..... 422/176
5,388,412 A * 2/1995 Schulte-Werning et al. ... 60/760

(Continued)

FOREIGN PATENT DOCUMENTS

EP 0 896 193 A2 10/1999
EP 0 896 193 A3 7/2000

OTHER PUBLICATIONS

PCT International Search Report and Written Opinion for International Application No. PCT/IB2011/002928, dated Aug. 16, 2013.

*Primary Examiner* — Carlos A Rivera
(74) *Attorney, Agent, or Firm* — Finnegan, Henderson, Farabow, Garrett & Dunner, LLP

(57) ABSTRACT

The gaseous fuel-fired can combustor for a gas turbine include a generally cylindrical housing, and a generally cylindrical liner disposed coaxially within the housing to define with the housing a radial outer flow passage for combustion air, the-liner also defining inner combustion and a dilution zone, the dilution zone being axially distant a closed housing end relative to the combustion zone. A fuel/air mixing apparatus disposed at the closed housing end includes a plurality of swirl vanes defining passages each having constant cross-section flow areas along the vanes, and an increasing aspect ratio from the passage inlet to the outlet. An impingement cooling sleeve coaxially disposed in the combustion air passage between the housing and the liner cools the portion of the liner defining the combustion zone. Channeling apparatus is disposed between a downstream end region of the sleeve and the mixing apparatus and includes a diffuser section with a ratio of the outlet flow area to the inlet flow area in a range of 1.3-1.5.

13 Claims, 4 Drawing Sheets

(56) References Cited

U.S. PATENT DOCUMENTS 5,557,918 A * 9/1996 Chyou et al. ..... 60/774
6,134,877 A * 10/2000 Alkabie ..... 60/800
6,438,959 B1 * 8/2002 Dean et al. ..... 60/760
6,546,733 B2 * 4/2003 North et al. ..... 60/772
2009/0120094 A1 * 5/2009 Norster ..... 60/752
2010/0275601 A1 * 11/2010 Berry et al. ..... 60/737

* cited by examiner

ULTRA LOW EMISSIONS GAS TURBINE COMBUSTOR

FIELD OF THE INVENTION

The present invention relates to can combustors. In particular, the present invention relates to gaseous fuel-fired, impingement cooled, dry low emission can combustors for gas turbine engines.

BACKGROUND OF THE INVENTION

Gas turbine combustion systems utilizing can type combustors are often prone to air flow mal-distribution. The problems caused by such anomalies are of particular concern in the development of low NOx systems. The achievement of low levels of oxides of nitrogen in combustors is closely related to flame temperature and its variation through the early parts of the reaction zone. Flame temperature is a function of the effective fuel-air ratio in the reaction zone which depends on the applied fuel-air ratio and the degree of mixing achieved before the flame front. These factors are obviously influenced by the local application of fuel and associated air and the effectiveness of mixing. Uniform application of fuel typically is under control in well designed injection systems but the local variation of air flow is often not, unless special consideration is given to correct mal-distribution.

The achievement of current levels of oxides of nitrogen set by regulations in some areas of the world calls for effective fuel-air ratio to be controlled to low standard deviations on the order of 10%. The cost of development of such combustion systems is high but can be significantly influenced by the right choice of configuration. However, the use of film cooling in these low flame temperature combustors generates high levels of carbon monoxide emissions. External impingement cooling of the flame tube (liner) can curtail such high levels. Moreover, in systems where high exit temperature is a performance requirement in addition to low NOx, the air flow to swirler/reaction zone is a large proportion of total air flow and therefore cooling and dilution air flows are limited. Hence there is considerable advantage in controlling these flows to optimize the overall flow conditions.

One such recent combustor design is that shown in U.S. Pat. No. 7,617,684 to Norster, assigned to the assignee of the present invention, the disclosure of which is hereby incorporated by reference. In the subject Norster combustor, essentially all the air flow for combustion is first separated from the dilution air stream and used for impingement cooling the portion of a combustor liner defining the combustion zone, and then channeled to swirl vanes for mixing with fuel. While the features of the Norster combustor may provide better control of the amount of air delivered to the swirl vanes, and thus the bulk fuel/air ratio, compared to previous impingement cooled combustors, further improvements in the aerodynamics of the combustion air flow to the swirl vanes may minimize local deviations in the fuel/air ratio. Improvements are also possible in the control of other cooling air flows in the combustor, which affect the level of emissions and the thermal efficiency of the combustor. Such improvements are set forth hereinafter.

SUMMARY OF THE INVENTION

In one aspect of the present invention, a gaseous fuel-fired can combustor for use with a gas turbine, for example in a gas turbine engine, includes a generally cylindrical housing having an interior, an axis, and a closed axial end. A generally cylindrical combustor liner is disposed coaxially within the housing interior and is configured to define with the housing a radial outer flow passage for combustion air. The liner also defines respective radially inner volumes for a combustion zone and a dilution zone, the dilution zone being axially distant the closed housing end relative to the combustion zone, and the combustion zone being axially adjacent the closed housing end. Mixing apparatus is disposed at the closed housing end and in flow communication with the combustion air passage. The mixing apparatus includes a plurality of vanes for mixing the gaseous fuel to be combusted with at least a part of the combustion air, and a mixing apparatus outlet for admitting the resulting fuel/air mixture to the combustion zone. An impingement cooling sleeve is coaxially disposed in the combustion air passage between the housing and the liner, the sleeve having a plurality of apertures sized and distributed to direct the combustion air against a radially outer surface of a portion of the liner defining the combustion zone, for impingement cooling the liner portion. Channeling apparatus is disposed in the combustion air passage for channeling the combustion air from an impingement cooling sleeve exit region to the inlet of the mixing apparatus. The channeling apparatus is configured to prevent flow separation and includes a diffuser section with an inlet flow area and an outlet flow area, wherein a ratio of the outlet flow area to the inlet flow area is in the range 1.3-1.5.

In another aspect of the present invention, the gaseous fuel can combustor for a gas turbine includes a generally cylindrical outer housing having an interior, an axis, and a closed end. A generally cylindrical combustor liner is disposed coaxially within the housing interior and is configured to define with the housing a radially outer flow passage for combustion air, with the liner having an interior defining a radially inner volume for a combustion zone proximate the housing closed end. Mixing apparatus including a plurality of swirl vanes is disposed at the housing closed end. The mixing apparatus has an inlet in flow communication with the combustion air flow passage and an axially directed outlet in flow communication with the combustion zone. The swirl vanes are arranged circumferentially spaced apart about the housing axis in a plane generally perpendicular to the axis. A gaseous fuel supply system is operatively connected to deliver gaseous fuel to the mixing apparatus in the vicinity of the swirl vanes for mixing with combustion air received from the combustion air flow passage. Adjacent ones of the circumferentially spaced apart vanes partly define generally radially inwardly directed mixing flow passages, wherein each the mixing flow passages has a substantially constant cross-sectional flow area and an increasing aspect ratio along a flow direction between the swirl vanes.

The accompanying drawings, which are incorporated in and constitute a part of this specification, illustrate several embodiments of the invention and, together with the description, serve to explain the principles of the invention.

DESCRIPTION OF THE EMBODIMENTS

Figures 1, 5:
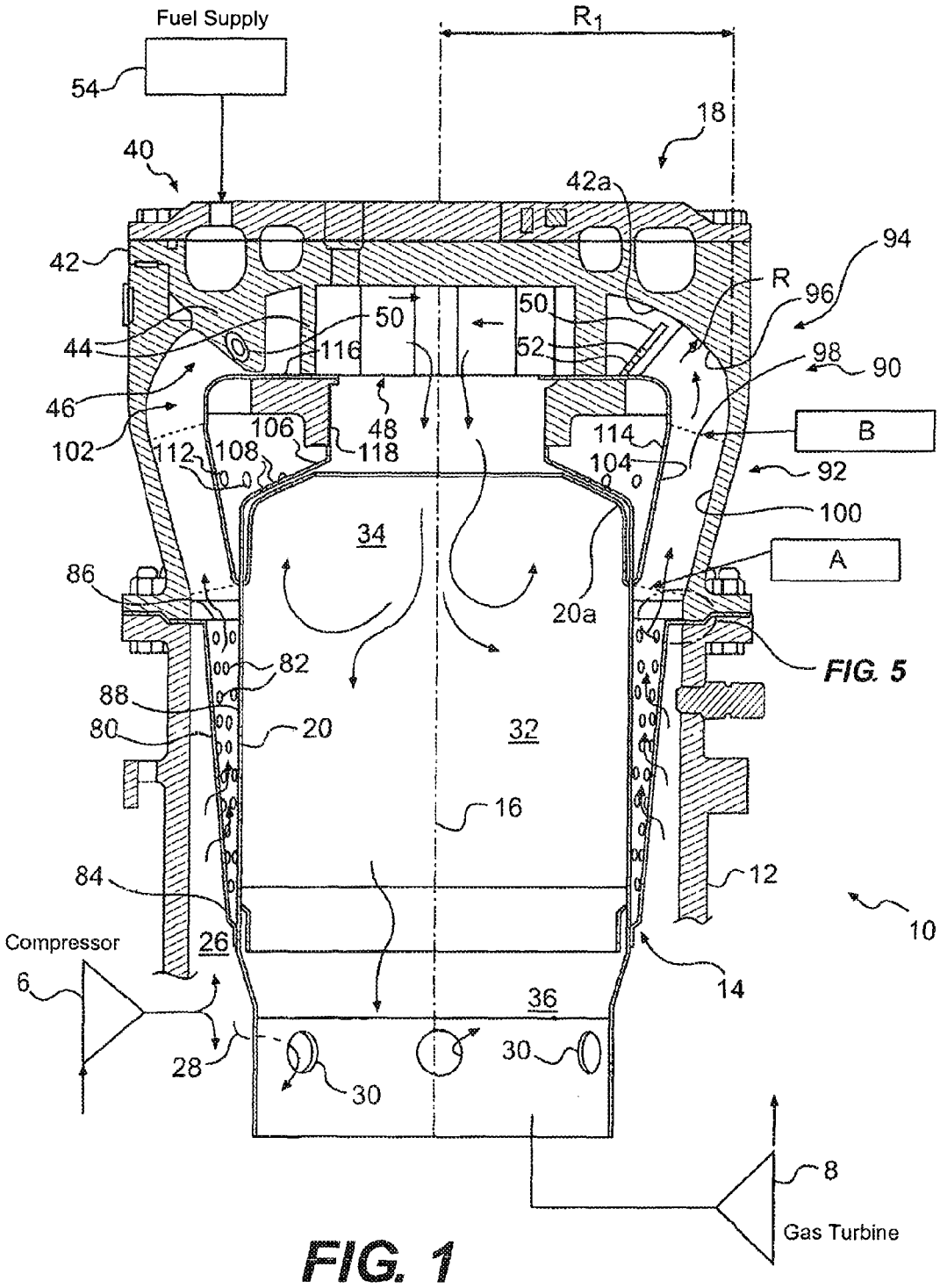
FIG. 1 is a schematic cross-sectional view of a gas turbine can combustor in accordance with the present invention.
FIG. 5 is a detail of the combustor in FIG. 1 showing holes for admitting air to minimize flow separation in the diffuser section.

The can combustor of the present invention, generally designated by the numeral 10 in the figures, is intended for use in combusting gaseous fuel with compressed air from compressor 6, and delivering combustion gases to gas turbine 8, e.g., for work-producing expansion such as in a gas turbine engine. See FIG. 1. Compressor 6 may be a centrifugal compressor and gas turbine 8 may be a radial inflow turbine, but these are merely preferred and are not intended to limit the scope of the present invention, which is defined by the appended claims and their equivalents.

In accordance with the present invention, as embodied and broadly described herein, the can combustor may include a generally cylindrical housing having an interior, an axis, and a closed axial end. As embodied herein, and with reference to FIG. 1, can combustor 10 includes outer housing 12 having interior 14, longitudinal axis 16, and closed axial end 18. Housing 12 is generally cylindrical in shape about axis 16, but can include tapered and/or step sections of a different diameter in accordance with the needs of the particular application and to accommodate certain features of the present invention to be discussed hereinafter.

In accordance with the present invention, the combustor also includes a generally cylindrical combustor liner disposed coaxially within the housing and configured to define with the housing respective radial outer passage for combustion air. The liner also defines respective radially inner volumes for a combustion zone and a dilution zone. The dilution zone is axially distant the closed housing end relative to the combustion zone, and the combustion zone is axially adjacent the closed housing end.

As embodied herein, and with continued reference to FIG. 1, combustor 10 includes combustor liner 20 disposed within housing 12 generally concentrically with respect to axis 16. Liner 20 may be sized and configured to define with housing 12 outer passage 26 for compressed air supplied from engine compressor 6 to be used for impingement cooling and combustion air. Liner 20 also partially defines dilution air path 28. In the FIG. 1 embodiment, path 28 for the dilution air includes a plurality of dilution ports 30 distributed about the circumference of liner 20.

The interior of liner 20 also defines combustion zone 32 axially adjacent closed end 18, where the swirling combustion air and fuel mixture is combusted to produce hot combustion gases. In conjunction with mixing apparatus 40 at closed end 18 (to be discussed hereinafter) liner portion 20*a* is configured to provide stable recirculation in region 34 of combustion zone 32, in a manner known to those skilled in the art. The interior of liner 20 further defines dilution zone 36 where combustion gases are mixed with dilution air from dilution ports 30 to lower the temperature of the combustion gases, before work-producing expansion in turbine 8.

Also, in accordance with the present invention, the combustor includes apparatus having a plurality of vanes for mixing at least a part of the combustion air with gaseous fuel, the mixing apparatus having an outlet for admitting the resulting fuel/air mixture to the combustion zone. As embodied herein, and with continued attention to FIG. 1, mixing apparatus 40 includes swirl plate 42 with a plurality of swirl vanes 44 disposed about the circumference of swirl plate 42, and mixing apparatus inlet 46 and outlet 48. Each vane 44 has a leading edge 68, trailing edge 70, top 72, and bottom 74. See FIG. 4. Mixing apparatus 40 further includes a plurality of nozzles 50, each preferably having multiple orifices 52 for injecting the gaseous fuel. Nozzles 50 are controllably fed from fuel supply 54 via appropriate valved connections and channels, as one skilled in the art would understand.

Figure 2:
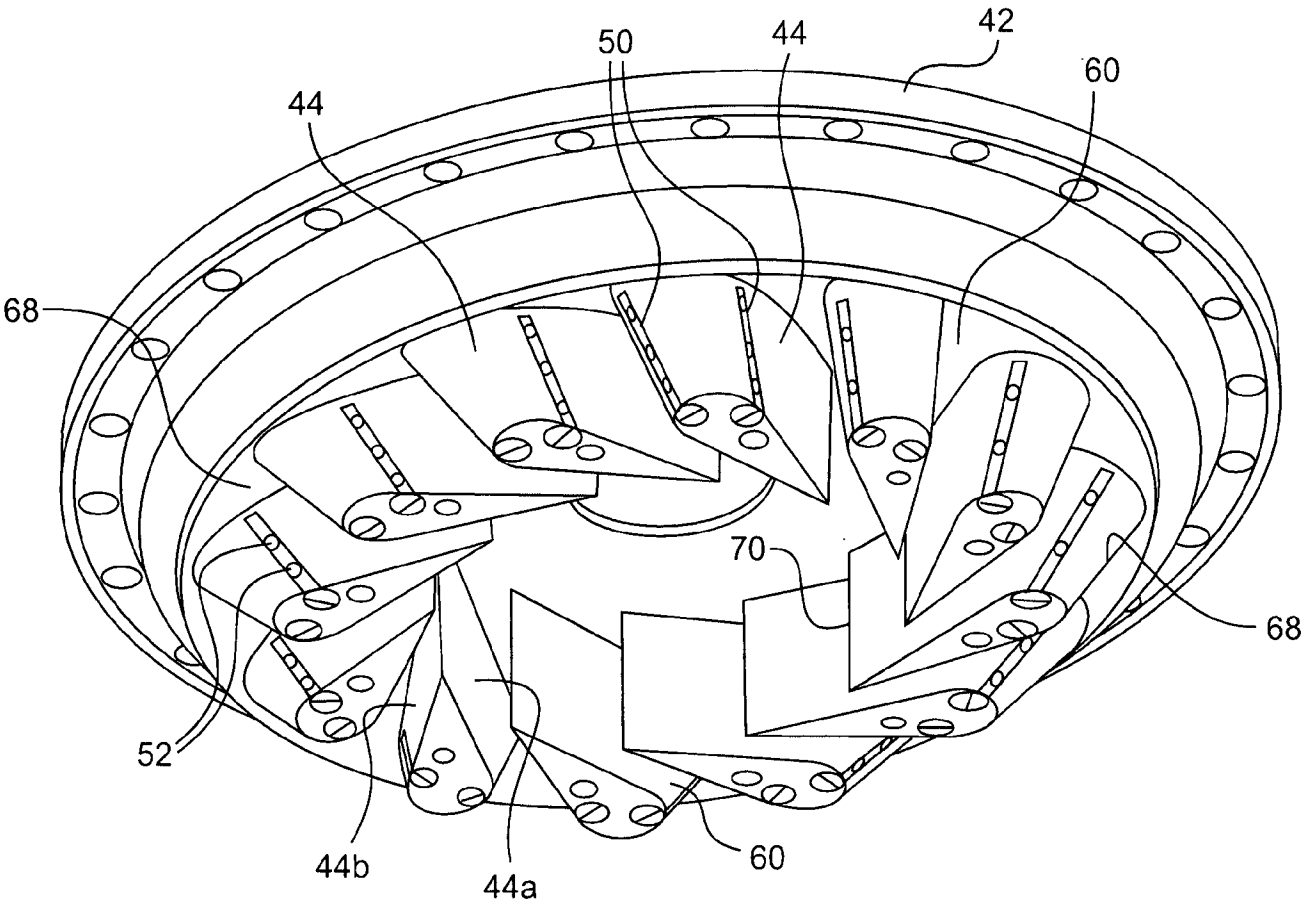
FIG. 2 is a detail of the mixing apparatus of the FIG. 1 combustor, including swirl vanes.
Figure 3:
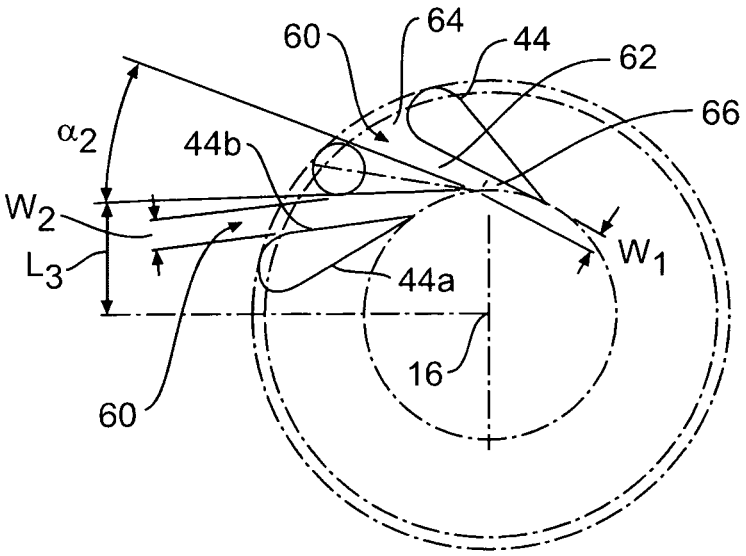
FIGS. 3 and 4 are, respectively, axial and side schematic views showing the design characteristics of the swirl vanes of the FIG. 1 combustor.
Figure 4:
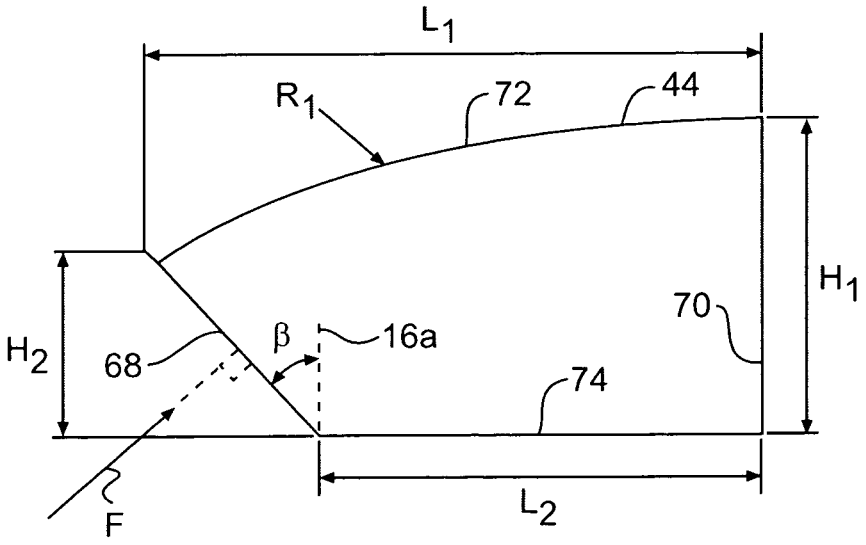
Figure 5:
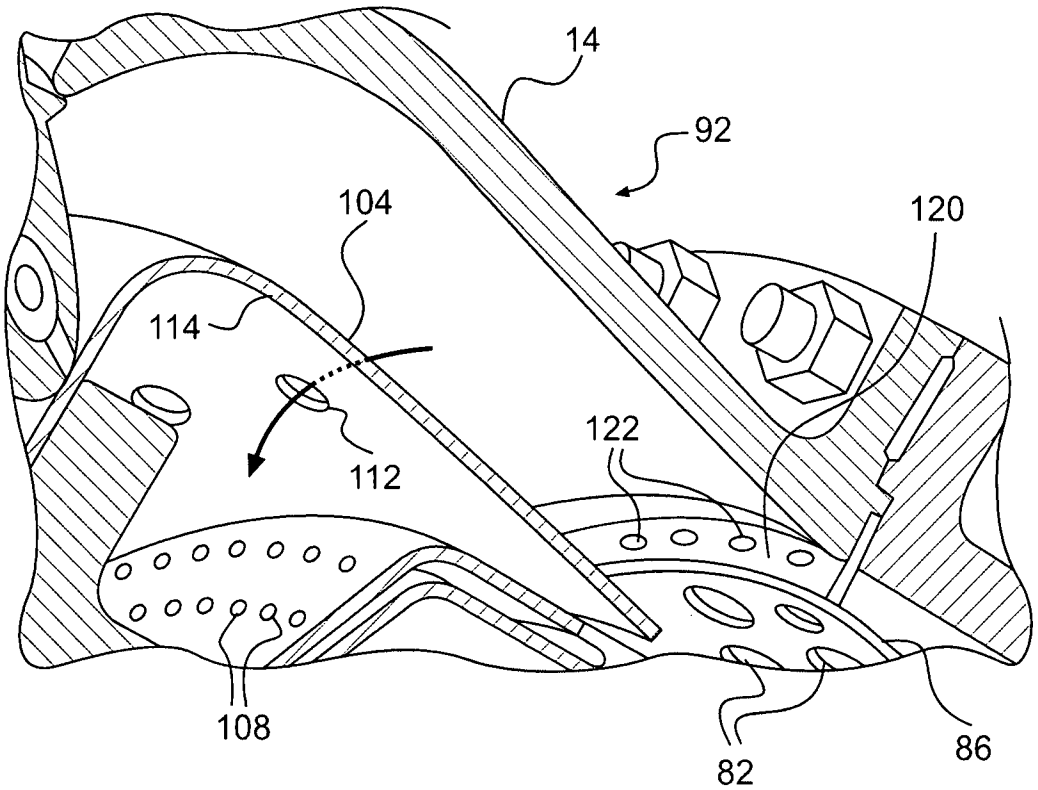

With reference now to FIGS. 2-4, swirl vanes 44 preferably are aerodynamically shaped with a taper angle of $\alpha_2$ and are spaced apart circumferentially to provide combustion air passages 60 with good fuel/air mixing without separation. Specifically, the passages 60 are configured to have a constant cross section flow area 62 between adjacent vanes but with a varying aspect ratio of passage height H to passage width W along the vane length from passage inlet 64 to passage outlet 66, respectively proximate vane leading edge 68 and vane trailing edge 70 (see FIG. 3). Preferably, the aspect ratio ranges from about 1.5 at passage inlet 64 to about 4.5 at passage outlet 66.

Further, and as best seen in FIG. 2, each vane 44 has a pair of nozzles 50 recessed into opposing sides 44*a*, 44*b* of the vane, each nozzle being proximate vane leading edge 68 and having a plurality of orifices 52 directed into a respective passage 60. Nozzles 50 can be configured to be replaceable e.g., with nozzles having different orifice sizes to accommodate different gaseous fuels, or for repair. Also, and as best seen in FIG. 4, leading vane edge 68 is preferably set at an angle β relative to the axial direction 16*a*, to better receive the incoming combustion air. The angle β may be set to be at right angles to the direction of the incoming air as depicted in FIG. 4.

Table 1 presents a particularly preferred set of design parameter ranges for the profile and orientation of vanes 44, in relation to the depiction in FIGS. 3 and 4.

TABLE 1

| Parameter | Min. value | Max. value |
|---|---|---|
| $L_1/L_2$ | 1.2 | 1.4 |
| $R_1/L_2$ | 2.5 | 2.6 |
| $H_2/L_2$ | 0.35 | 0.45 |
| $H_1/L_1$ | 0.65 | 0.75 |
| $\alpha_2$ | 20° | 25° |
| $H_2/W_2$ | 1.4 | 1.6 |
| $H_1/W_1$ | 4.4 | 4.6 |

Still further in accordance with the present invention, as embodied and broadly described herein, the can combustor may further include an impingement cooling sleeve coaxially disposed between the housing and the combustion liner and extending axially from the closed housing end for a substantial length of the combustion zone. The impingement cooling sleeve may have a plurality of apertures sized and distributed to direct combustion air against the radially outer surface of the portion of the combustor liner defining the combustion zone, for impingement cooling.

As embodied herein, and with reference to FIG. 1, impingement cooling sleeve 80 is depicted coaxially disposed between housing 12 and liner 20. Impingement cooling sleeve 80 extends axially along a portion of liner 20 defining combustion zone 32 from a location adjacent closed end 18 to a location proximate but upstream of dilution ports 30 relative to the axial flow of the combustion gases. Sleeve 80 includes a plurality of impingement cooling orifices 82 distributed circumferentially around sleeve 80 and configured and oriented to direct combustion air in passage 26 against the outer surface of liner 20 in the vicinity of combustion zone 32. It is preferred that the shape of the impingement cooling sleeve 80 be axially tapered, to achieve a frusto-conical shape with an increasing diameter from sleeve end 84 to sleeve end 86 which comprises the exit region for the combustion air flow after it has traversed sleeve 80 and has impingement cooled liner surface 88. The sleeve end 84 preferably is configured to seal the combustion/impingement cooling air in passage 26 from dilution air path 28 after the combustion air his traversed impingement cooling orifices 82.

Significantly, in the embodiment depicted in FIG. 1, essentially all of the combustion air eventually admitted to combustion zone 32 first passes through orifices 82 of impingement sleeve 80 to provide cooling, that is, all except possibly unavoidable leakage. Combustion air may comprise between about 45-55% of the total air supplied to the can combustor (combustion air plus dilution air) for low NOx configurations.

Still further in accordance with the invention, as embodied and broadly described herein, the can combustor includes apparatus for channeling the combustion air from an exit region downstream of the impingement cooling sleeve to an inlet of the mixing apparatus. The channeling apparatus is configured to prevent flow separation and includes a diffuser section with an inlet flow area and an outlet flow area, with the ratio of the outlet flow area to the inlet flow area being in the range 1.3-1.5 or greater.

As embodied herein, and with reference to FIG. 1, channeling apparatus 90 includes diffuser section 92 and a guide section 94, both comprising sequential parts of the combustion air flow passage 26. Diffuser section 92 extends between a location "A" downstream of sleeve exit region 86 to a location "B" which is the beginning of inwardly curved guide section 94. Guide section 94, in turn, extends from location "B" to inlet 46 of mixing apparatus 40 proximate leading edges 68 of swirl vanes 44. Guide section 94 serves to turn the combustion air inwardly toward axis 16 and mixing apparatus inlet 46 with a minimum of flow separation using smoothly curved inner surface 96 of housing 1 and surface 42*a* of swirl plate 42, with a large radius of curvature. As depicted in FIG. 1, guide section surface 96 should preferably be configured to have the same O.D. and curvature at the location of leading edge 68 as swirl plate surface 42*a*, to avoid an abrupt step and possible flow separation.

It may specifically be preferred to use a radius of curvature r that satisfies the following relations:

$$1.15 \le \frac{r}{H_1} \le 1.35, \text{ and } 0.35 \le \frac{r}{R_1} \le 0.45,$$

where $H_1$ is the height of vane 44 at trailing edge 70, and $R_1$, is the radial distance from axis 16 to inner surface 96 of housing 18 at the beginning of guide section 94 (location B). See FIGS. 1 and 4. Also, it may specifically be preferred that vanes 44, as well as swirl plate 42, be configured such that the air and fuel mixture leaves the swirl vanes 44 in the tangential direction relative to axis 16 (within ±3°). This provides the longest flow path for the air and fuel mixture, which gives a more homogenous mixture. This feature has been made possible due to the varying aspect ratio in the swirl vane passages.

Returning to diffuser section 92, diffuser flow area 98 in the depicted embodiment is the space between the conical inside surface 100 of housing 14 between locations "A" and "B", and the conical outside surface 104 of wall 114 of toroidal spacer member 102. These two conical surfaces are sized and configured to provide a continuously increasing annular diffuser flow area from the diffuser section inlet (location "A") to diffuser section outlet (location "B") to provide an expansion ratio of the outlet flow area to the inlet flow area in the range of 1.3-1.5, via a smooth, continuous expansion. The consequent lowering of the average velocity may provide a more optimum velocity ratio between the combustion air entering mixing apparatus 40 and the fuel injected from nozzles 50, thus providing more uniform mixing.

One skilled in the art would understand from the above that the configuration of the surfaces defining diffuser section 92 need not both be conical to provide the desired expansion ratio. That is, wall 114 with outer surface 104 of toroidal spacer member 102 could be cylindrical while inner surface 100 of diffuser section 42 of housing 14 could be conical, or vice versa. While each of these alternatives may result in a more radially compact combustor, each would increase the severity of hydraulic losses in guide section 94 due to the sharper turn (smaller radius of curvature) proximate mixing apparatus inlet 46, and hence may not be preferred. In the FIG. 1 embodiment, the bulk combustion air flow through diffuser section 92 is slightly away from axis 16, while the flow through guide section 94 is toward axis 16, allowing most of the turning to be accomplished smoothly over an extended guide section length and not abruptly at the mixing apparatus inlet. Dish-shaped curved mixing plate surface 42*a*, which provides the upper boundary of swirl vane passages 60, also helps turning the combustion air.

It may also be preferred that a small fraction (~14%) of the combustion air from the diffuser section 92 be used to cool the "head" end of liner 20, namely, liner part 20*a* surrounding portion 34 of the combustion zone, where the recirculated combustion gases can create high heat loading. In the FIG. 1 embodiment, toroidal member 102 can be configured with inner wall 106 spaced from liner portion 20*a* and provided with directed impingement cooling apertures 108. In the FIG. 1 embodiment, the combustion air for impingement cooling liner portion 20*a* enters toroidal member 102 through apertures 112 in outer wall 114.

Still further and as best seen in FIG. 1, top wall 116 of toroidal member 102 abuts swirl vanes 44 and defines the bottom portions of swirl vane passages 60.

It may be further preferred to use another small fraction (~1%) of the combustion air to prevent flow separation at the diffuser inlet A. As best seen in FIG. 5, impingement sleeve 80 is captured to housing 14 via a flanged connection that causes step 120. To prevent flow separation due to the sudden expansion in the flow area at step 120, bleed holes 122 are provided in step 120 and are supplied with combustion air from passage 26 upstream of impingement sleeve 80.

As a consequence of the features of the can combustor described above, and in addition to the advantage of the more uniform air flow to the swirl vanes discussed previously, the can combustor may provide more uniform premixing in the swirl vanes and, consequently, a higher effective fuel-air ratio for a given NOx and CO requirement. Also, the above-described can combustor may provide a higher margin of stable burning, in terms of providing a more stable recirculation pattern and may also minimize temperature deviations ("spread") in the combustion products delivered to the turbine. Finally, the can combustor disclosed above may also maximize the effectiveness of the cooling air and provide optimum liner wall metal temperatures.

It will be apparent to those skilled in the art that various modifications and variations can be made in the disclosed impingement cooled can combustor, without departing from the teachings contained herein. Although embodiments will be apparent to those skilled in the art from consideration of this specification and practice of the disclosed apparatus, it is intended that the specification and examples be considered as exemplary only, with the true scope being indicated by the following claims and their equivalents.

What is claimed is:

1. A gaseous fuel-fired can combustor for a gas turbine engine, the can combustor comprising:

a generally cylindrical housing having a housing interior, a housing axis, and a closed housing end;

a generally cylindrical combustor liner disposed coaxially within the housing interior and configured to define with the generally cylindrical housing a radial outer flow combustion air passage, the generally cylindrical combustor liner also defining respective radially inner volumes for a combustion zone and a dilution zone, the dilution zone being axially distant to the closed housing end relative to the combustion zone, and the combustion zone being axially adjacent the closed housing end;

a mixing apparatus disposed at the closed housing end and in flow communications with the combustion air passage, the mixing apparatus including a plurality of vanes for mixing gaseous fuel to be combusted with at least a part of combustion air and a mixing apparatus outlet for admitting a resulting fuel/air mixture to the combustion zone;

an impingement cooling sleeve coaxially disposed in the combustion air passage between the generally cylindrical housing and the generally cylindrical combustor liner, the impingement cooling sleeve having a first plurality of apertures sized and distributed to direct combustion air against a radially outer surface of a combustion liner portion of the generally cylindrical combustor liner defining the combustion zone for impingement cooling the combustion liner portion; and a channeling apparatus disposed in the combustion air passage for channeling combustion air from an impingement cooling sleeve exit region to an inlet of the mixing apparatus, wherein the channeling apparatus is configured to prevent flow separation and includes a diffuser section with a diffuser section inlet flow area and a diffuser section outlet flow area, and wherein a ratio of the diffuser section outlet flow area to the diffuser section inlet flow area is between 1.3-1.5, wherein a flanged connection is provided between the impingement cooling sleeve and the generally cylindrical housing proximate the diffuser section inlet flow area, and wherein a second plurality of apertures are provided for injecting air into the diffuser section immediately downstream in the combustion air passage of the flanged connection to prevent flow separation in the diffuser section using combustion air from the combustion air passage that has not passed through the impingement cooling sleeve.

2. The can combustor as in claim 1, wherein the diffuser section inlet flow area and the diffuser section outlet flow area are each generally annular in shape and are disposed coaxially with the generally cylindrical combustor liner, the diffuser section inlet being proximate the impingement cooling sleeve exit region.

3. The can combustor as in claim 2, wherein the diffuser section includes a conically shaped wall member coaxially disposed within, and radially spaced from, the generally cylindrical housing and a conically shaped inner surface of an adjacent housing portion, and wherein a cross-sectional flow area between the conically shaped wall member and the conically shaped inner housing surface increases continuously between the diffuser section inlet flow area and the diffuser section outlet flow area.

4. The can combustor as in claim 1, wherein the diffuser section is defined by at least one coaxial conical surface.

5. The can combustor of claim 1, wherein the channeling apparatus includes a guide section disposed between the diffuser section outlet area and the inlet of the mixing apparatus and configured to turn combustion air received from the diffuser section outlet toward the inlet of the mixing apparatus.

6. The can combustor as in claim 5, wherein the guide section is disposed and configured to turn combustion air received from the diffuser section outlet along a first flow direction generally diverging away from the housing axis to a second flow direction that is generally radially converging toward the housing axis.

7. The can combustor as in claim 1 wherein the plurality of vanes are mounted on a plate member, the plate member being oriented generally perpendicular to the housing axis; wherein each vane is configured with a pair of replaceable fuel nozzles recessed in opposed vane sidewalls proximate a vane leading edge; and wherein each of the pair of replaceable fuel nozzles has a plurality of injection orifices.

8. The can combustor as in claim 1, wherein the vanes of the mixing apparatus are configured as swirl vanes equally spaced circumferentially about the housing axis, the swirl vanes being configured to define respective swirl vane passages between adjacent vanes; and wherein the swirl vane passages have a constant cross-sectional flow area along a vane length and an increasing aspect ratio from a vane leading edge to a vane trailing edge.

9. The can combustor as in claim 8, wherein a swirl vane passage aspect ratio increases from about 1.5 at the vane leading edge to about 4.5 at the vane trailing edge.

10. The can combustor as in claim 1, further including a generally toroidally shaped spacer member coaxially disposed between the closed axial end and the generally cylindrical combustor liner, the generally toroidally shaped spacer member being configured to include an inner wall surrounding and spaced from a recirculation liner portion defining a recirculation portion of the combustion zone to define a passage for cooling air;

wherein the inner wall has a third plurality of apertures configured and arrayed for impingement cooling the recirculation liner portion; and wherein an outer wall of the generally toroidal shaped spacer member includes one or more holes flow-connecting an interior of the generally toroidal shaped spacer member and the diffuser section for supplying a minor part of combustion air for impingement cooling the recirculation liner portion.

11. The can combustor as in claim 5, wherein the vanes of the mixing apparatus are swirl vanes disposed circumferentially about the housing axis, wherein the swirl vanes have leading edges for intercepting a flow of combustion air from the guide section, and wherein the leading edges are configured to be substantially perpendicular to an intercepted flow of combustion air.

12. A gas turbine engine comprising the can combustor of claim 1 operatively interconnected between an air compressor and a gas turbine.

13. A gaseous fuel-fired can combustor for a gas turbine engine, the can combustor comprising:

a generally cylindrical housing having a housing interior, a housing axis, and a closed housing end;

a generally cylindrical combustor liner disposed coaxially within the housing interior and configured to define with the generally cylindrical housing a radial outer flow combustion air passage, the generally cylindrical combustor liner also defining respective radially inner volumes for a combustion zone and a dilution zone, the dilution zone being axially distant to the closed housing end relative to the combustion zone, and the combustion zone being axially adjacent the closed housing end;

a mixing apparatus disposed at the closed housing end and in flow communications with the combustion air passage, the mixing apparatus including a plurality of vanes for mixing gaseous fuel to be combusted with at least a part of combustion air and a mixing apparatus outlet for admitting a resulting fuel/air mixture to the combustion zone;

an impingement cooling sleeve coaxially disposed in the combustion air passage between the generally cylindrical housing and the generally cylindrical combustor liner, the impingement cooling sleeve having a plurality of apertures sized and distributed to direct combustion air against a radially outer surface of a combustion liner portion of the generally cylindrical combustor liner defining the combustion zone for impingement cooling the combustion liner portion; and a channeling apparatus disposed in the combustion air passage for channeling combustion air from an impingement cooling sleeve exit region to an inlet of the mixing apparatus, wherein the channeling apparatus is configured to prevent flow separation and includes a diffuser section through which combustion air flows from the impingement cooling sleeve exit region to the inlet of the mixing apparatus, the diffuser section having a diffuser section inlet flow area downstream in the combustion air passage from the plurality of apertures and a diffuser section outlet flow area, and wherein a ratio of the diffuser section outlet flow area to the diffuser section inlet flow area is between 1.3-1.5, wherein the diffuser section includes a conically shaped wall member coaxially disposed within, and radially spaced from, the generally cylindrical housing and a conically shaped inner surface wall of a housing portion adjacent to the diffuser section, wherein a cross-sectional flow area of the diffuser section between the conically shaped wall member and the conically shaped inner surface increases continuously between the diffuser section inlet flow area and the diffuser section outlet flow area; and wherein a top wall of the conical shaped wall member abuts the plurality of vanes.

* * * * *